United States Patent [19]

Frankie

[11] 4,369,626

[45] Jan. 25, 1983

[54] HOT-AIR DISTRIBUTION SYSTEM

[76] Inventor: Thomas T. Frankie, 2415 Plaza Del Mar, Escondido, Calif. 92025

[21] Appl. No.: 288,619

[22] Filed: Jul. 30, 1981

[51] Int. Cl.[3] ..... F23H 13/00; F02G 1/02

[52] U.S. Cl. ..... 60/517; 126/121; 60/721

[58] Field of Search ..... 60/517, 721; 126/121

[56] References Cited

U.S. PATENT DOCUMENTS 4,085,588 4/1978 Reams et al. ..... 60/517

4,204,519 5/1980 Towery ..... 126/121 X

*Primary Examiner*—Allen M. Ostrager

*Attorney, Agent, or Firm*—Ralph S. Branscomb

[57] ABSTRACT

A self-contained, self-powered hot air distribution system is provided which utilizes a Stirling engine, the hot end of the displacement cylinder of which extends into a fireplace or other heat source, with a fan or blower which is powered by the Stirling engine blowing air over the cold end of the displacement cylinder and into the fireplace or other heat source and back out into an area to be space heated.

15 Claims, 11 Drawing Figures

HOT-AIR DISTRIBUTION SYSTEM

BACKGROUND OF THE INVENTION

Beginning with the increase in energy costs of the seventies, all manner of devices have been developed for burning wood, used engine oil, paper, animal fat and everything else that is combustible, for use particularly in backwoods areas where such materials are readily available. At the same time, in conjunction with these furnaces, stoves and ovens, many devices are marketed which either actively or passively increase the circulation of hot air from a fireplace out into the room in which the fireplace is situated to increase the efficiency of space heating from a fireplace, which in its natural state is rather low.

The above-mentioned systems, which run pipes through the firepit area of a fireplace and are active, generally have an electric motor driving a fan or blower which causes the air to circulate through the firepit and back out into the open area. This is quite an effective system and greatly enhances the heating effect of a fireplace. Rooms which were previously warm only near the firepit can now be warmed throughout due to the convection effects of these devices.

However, because these active systems uniformly rely on an external supply of energy, i.e. electricity, they are obviously not as versatile as they would be otherwise. Although the electricity used to drive the blower motor may not be significant in terms of energy consumption compared to the heat of the fire which is transferred into the room, the fact that electricity is required has two serious drawbacks. Principally, the unit cannot be used in backwoods areas that do not have utilities. Secondarily, in the event of a blackout, which some people fear considerably, or a massive failure of the nations's energy supply system, the unit would be ineffective when it is needed most. There is a need, therefore, for such a unit, capable of creating hot air convection into a room, which is independent of electricity or other external energy source, but draws on the fire itself to produce an active circulation effect.

SUMMARY OF THE INVENTION

The present invention fulfills the above stated need and utilizes a Stirling engine powered by the fire to drive a pair of blowers which deliver a considerable volume of fresh air through pipes disposed in the firepit, where the air is heated and then blown out into the room. The incoming air is used to cool the cold end of a Stirling engine before the air is blown into the firepit to be heated further and delivered to the room.

The Stirling engine disclosed and claimed herein is designed to maximize the efficiency of the unit by utilizing a special crankcase which is in the shape of a disk, and in which revolves a disk-shaped crank and a pair of connecting rods which connect respectively to the displacement and power cylinders and are designed to occupy the maximum possible amount of space in the passage between the two cylinders, which includes the crankcase.

Although the unit as shown is geometrically laid out to fit in a fireplace, the basic operational qualities would be equally useful in other applications, including stoves, propane heating systems such as are found in recreational vehicles, and possible solar heating systems for heating both air for space heating and water.

DETAILED DESCRIPTION OF THE PREFERRED EMBODIMENT

Figure 2:
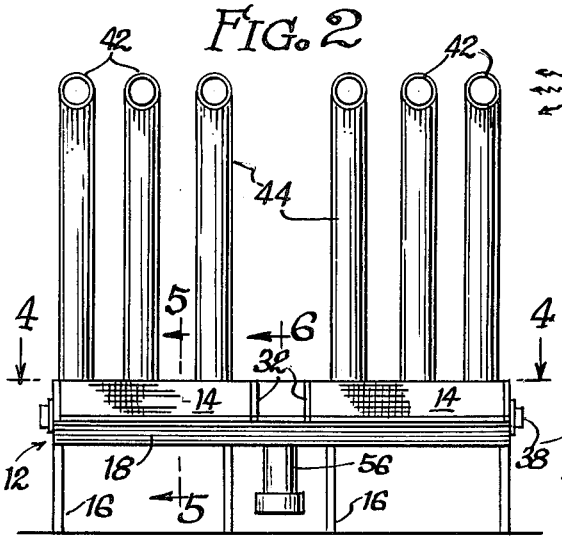
FIG. 2 is a front elevation view of the heater.
Figure 3:
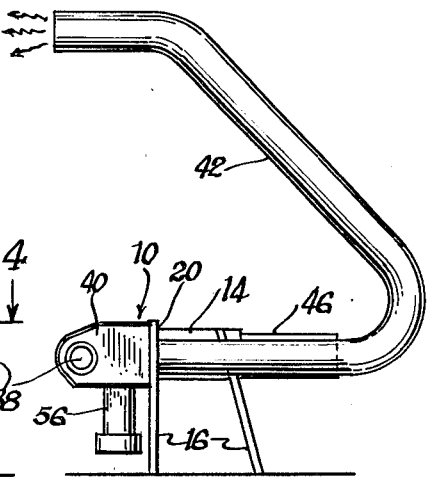
FIG. 3 is a side elevation view of the heater.

The invention is integrated with a frame 10 having an elongated cross member 12, a rearwardly projecting portion 14 and support legs 16. The cross portion 12, as best seen in FIG. 2, includes a continuous elongated bottom tray 18, a rear manifold portion 20 defining ports 22, venting to the rear and attached to the heating pipes seen in FIG. 4, and an interior curved baffle 26 which is actually divided into two sections, again as may be seen in FIG. 4. The top of the elongated portion is covered with a screen 28, and inside a pair of blowers 30 are journalled on opposite sides of motor mount walls 32. The blowers are connected by a central axle 34 which passes through the motor mount walls, and are journalled at their outer ends by stub axles 36 which rotate in bearings 38. End walls 40 mount the bearings 38, so that the cross member 12 is enclosed except for the open screen 28, and the rearwardly open ports and the jacket 24.

At the underside of the frame, a screen 39 is mounted to hold coals adjacent the hot air pipes. A depression 41 beneath the displacement cylinder ensures an adequate supply of coals to power the engine.

Figure 5:
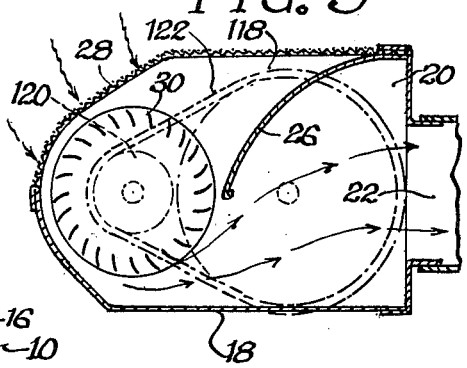
FIG. 5 is a section taken along line 5—5 of FIG. 2.

As can be seen in FIG. 5, operation of the structure just described is such that rotation of the in the direction shown draws air in through the upper screen and out the rear ports 22. These ports connected to the re-curved pipes 42, and the central jacket 24 is of slightly different construction but still terminates in a pair of re-curved pipes 44, with all the pipes being directed back out of the fireplace.

The walls 32 provide mounts for the Stirling engine, which will first be described in relation to its functional aspects illustrated in FIG. 6. The rearwardly projecting portion of the frame 10 includes a stainless steel displacement cylinder 46 which is made in two segments. The segment to the right is a simple stainless steel wall which is capped at the end and will be referred to as the "hot end" of the displacement cylinder as this end is inserted into, or near the fire to absorb as much heat as possible.

Figure 1:
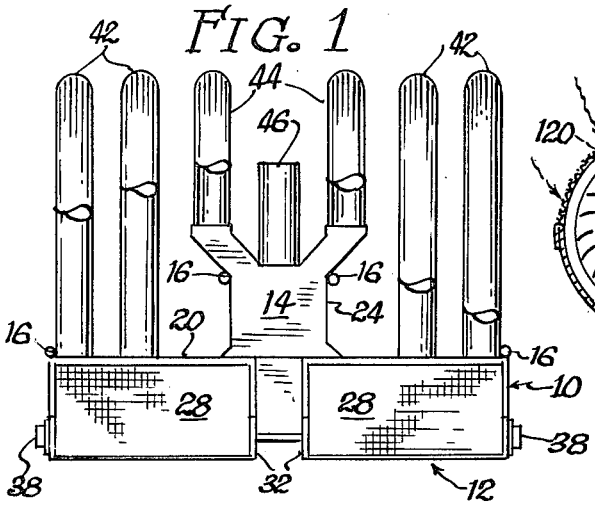
FIG. 1 is a top elevation view of the heater.
Figures 6, 7, 8, 9, 10, 11:
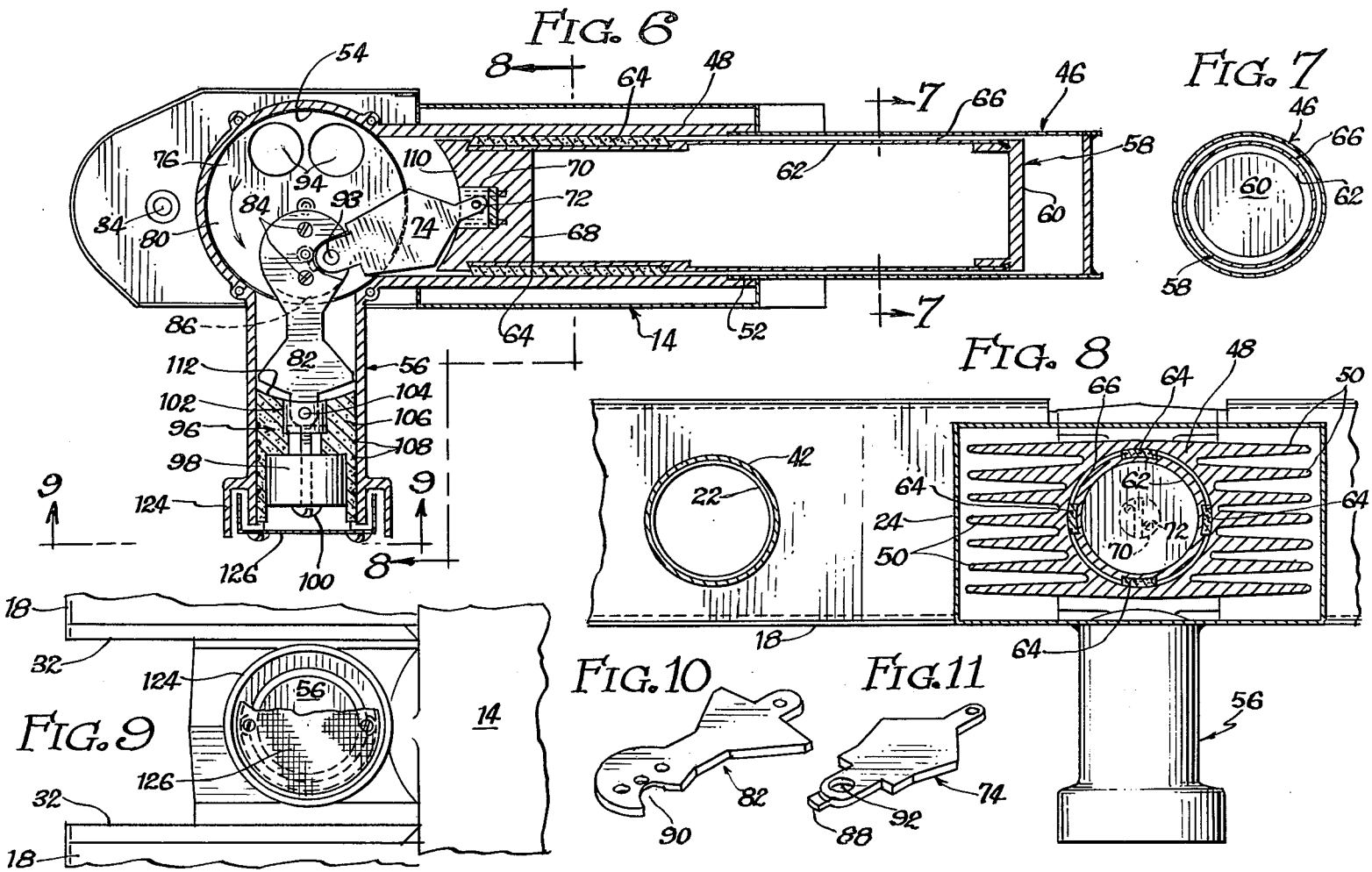
FIG. 6 is a longitudinal section taken centrally through the heater to illustrate the working mechanism and especially the crankcase.
FIG. 7 is a section taken along line 7—7 of FIG. 6.
FIG. 8 is a section taken along line 8—8 of FIG. 6.
FIG. 9 is a detail partially cut away, taken along line 9—9 of FIG. 6.
FIG. 10 is an isometric of the power piston connecting rod.
FIG. 11 is an isometric of the displacement piston connecting rod.

The other portion of the cylinder to the left is incorporated as an integral part of the heat dissipator 48, best seen in FIG. 8, which has cooling fins 50 which extend out into the body of the jacket 24, also visible in FIG. 8. The left end is the cool end, and mates with the hot end at an overlapping seam 52. At this point, the jacket seals against the displacement cylinder wall, separating the exterior of the cold end from the hot end. As seen in FIG. 1, the jacket continues outward into the pipes 44 so that a continuous supply of fresh air passes across the heat dissipator 48 when the device is in motion.

Figure 4:
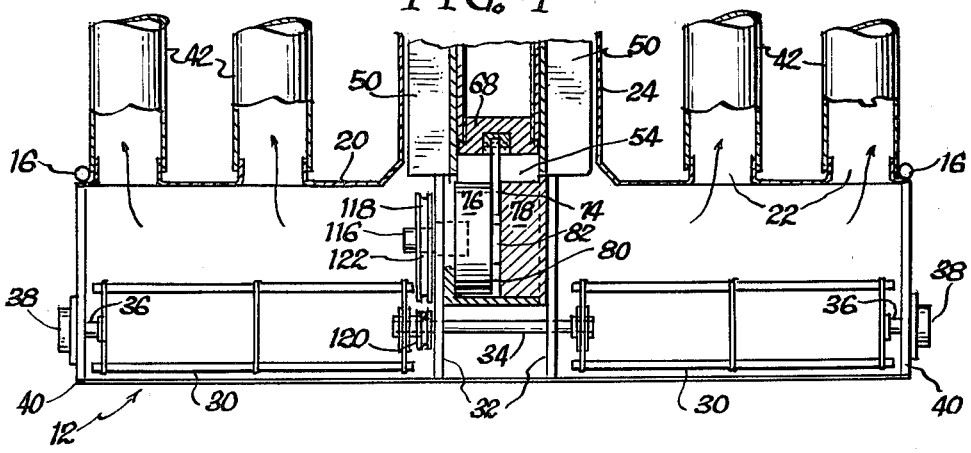
FIG. 4 is a section taken along line 4—4 of FIG. 2 but with the top screen removed.

Referring to FIG. 6, the left end of the displacement cylinder 46 mates with a crankcase 54, also seen in FIG. 4. The crankcase is cylindrical and extends perpendicularly to the axis of the displacement cylinder, and is also perpendicular to the power cylinder 56 which is sealed to the lower opening in the crankcase. Contrary to the displacement cylinder, the power cylinder is essentially open at the bottom.

Turning again to the displacement cylinder, this cylinder houses a displacement piston 58, which is lightweight and can be made of aluminum. It has an end plug 60, a generally cylindrical sidewall 62, and four graphite strips 64 embedded in the walls longitudinally of the piston at the cool end of the cylinder. These graphite strips can be seen in FIG. 8. The graphite strips define a space 68 between the piston and the cylinder, which space is slightly interrupted by the graphite strips themselves but otherwise permits communication between the hot and cold ends of the displacement cylinder.

The left plug 68 of the displacement cylinder, also preferably of aluminum, includes an insert plug 70, visible in phantom in FIG. 8 as well as in FIG. 6, this plug being screwed into the main plug 68 and having a pin 72 which passes through the flat connecting rod 74, best shown in FIGS. 6 and 11.

Turning to FIG. 4, the crank 76 within the crankshaft is in the shape of a disk and fits within the crankcase such that together with the opposing cylindrical plug 78 a disk-shaped void 80 is formed between the crank and the plug.

In this disk-shaped void both connecting rods 74 and the power piston connecting rod 82 ride. The rod 82 has a generally circular top which is screwed at 84 into a disk 86 which rides in another disk-shaped void, not shown, bored into the crank disk 76. Thus, rotation of the crank disk causes the eccentric motion of the rod 82.

The displacement connecting rod 74 has a key 88 which keys into keyway 90 to insure that the rods do not fall into overlapping relation. An opening 92 in the rod 74 is engaged on post 94 extending from the disk 86. Two bored holes 94 in the crank disk are filled with lead to balance the engine. The power piston comprises a brass weight 98 connected by means of bolt 100 which screws into a plug 102 having a pin 104 which connects it to the power piston connecting rod.

The plug 102 and the weight 98 are seated in a generally cylindrical low-friction carbon graphite sheath 106 which has a plurality of annular grooves 108.

The inner surfaces of the pistons designated 110 and 112 respectively are cylindrical and when in their closest position to the crankcase conform closely to the contours of the crank disk 76 and the plugs 78. The flattened connecting rods 74 and 82, which could be rod-shaped, are provided in the strange looking shapes illustrated because these shapes define the greatest planform of the rod which will still clear all of the obstacles within the cylinders and crankcase throughout a full cycle of motion. The shapes of the piston surfaces 110 and 112, and the connecting rods, are designed to absolutely minimize the space in the crankcase not occupied by a solid, as this space cuts into the efficiency of the engine insofar as it exceeds the passage necessary for relatively free communication of air between the displacement cylinder and the power cylinder.

The crank disk 76 rotates on a fixed boss 114 through which it passes a drive shaft 116 which drives a large pulley 118. The large pulley drives a small pulley 120 by means of a silicon belt 122. The small pulley is mounted on the central axle 134 which connects the two blower blowers.

The bottom of the power piston is vented to the atmosphere, such as with a skirt 124 which mounts a screen 126. Clearly, any venting which prevents entry of dust and ashes into the end of the power cylinder would be adequate.

Standard Stirling engine operation occurs when the piston 98 is pushed upwardly, or one of the blowers is rolled. Motion will only occur in the counter-clockwise direction as shown in FIG. 6 by the nature of the phasing of the two pistons. As the air heats up in the hot end of the displacement cylinder, which has maximum volume 90° before the position shown in FIG. 6, the power piston is depressed by the expanded air. At increased pressure, the power piston 96 is driven down, and as it moves it displaces the air from the hot end of the displacement cylinder through the passageway 66 into the cold end. In the position shown in FIG. 6, half of the air has been displaced and begins to contact. As inertia and decreasing air pressure carrys the piston back up, at its halfway point the air is fully in the cold end of the cylinder, and the rotation continues in this fashion.

The speed of operation of the engine is surprisingly fast due to the narrowness of the chamber 66, causing rapid heat transfer as the working air mass is shifted back and forth from one side of the displacement piston to the other. Speeds of four or five hundred RPM are easily achievable, and because of the step-up pulley structure driving the blowers, blower speed of fifteen hundred RPM is not unusal.

Since the working fluid of the engine is air, it never needs replacing and the engine is ideal for an application such as in a fireplace. However, other applications can be made of modifications of the device for use in propane heating systems and motor homes. Many of these systems utilize a passive radiation heat dissipation principle that is not particularly effective, and heat dissipation would be improved considerably by the use of a system of the type shown. Clearly, it could be modified for use in stoves, particularly wood burning type stoves.

Although the fluid which is heated in the illustrated embodiment is air, it could also be water or some other liquid with the the motive mechanism being a liquid pump. Such a system could be utilized in a solar system, for example by concentrating solar rays on the hot end of the displacement cylinder while cooling the cold end with the same technique as the illustrated embodiment. This would in effect achieve the results of the passive solar water heating system with the hot water tank above the solar plates, i.e. no electricity would be required, but without requiring that the tank be elevated.

Other related uses of the machine, using the basic principle of the Stirling engine, with the hot end in a heat source and the cold end being upstream in a pathway of fluid to be heated by passing it through the heat source, are conceivable and intended to be within the scope of the disclosure and claims appended hereto.

What is claimed is:

1. A heated fluid distributor for space heating which utilizes a heat source to both operate a Stirling engine and heat fluid moved by a mechanical fluid mover operated by said Stirling engine, said distributor comprising:

(a) a frame;

(b) a Stirling engine mounted on said frame with the hot end of the displacement cylinder extendable into thermal contact with said heat source when the distributor is in its operative mode;

(c) means defining a fluid path passing relatively cool ambient air in thermal contact with said heat source when the distributor is in operative mode to warm said air, and said fluid path being hermetically separated therefrom to prevent the admixture of any combustion gases from said source to said air to adulterate same, said fluid path also being directed into and terminating in communication with the ambient space to be heated to deliver unadulterated air so warmed thereinto; and (d) a mechanical fluid mover operated by said engine to drive said fluid along said path.

2. A distributor according to claim 1 wherein said fluid path passes over the cold end of the displacement cylinder upstream of said heat source.

3. Structure according to claim 2 wherein said cold end defines a plurality of extended heat dissipation vanes and said means defining a fluid path includes a jacket around said cold end and vanes.

4. Structure according to claim 3 wherein said heated fluid distributor is designated for use in a fireplace and said fluid is air, and said displacement cylinder is generally horizontally extended with the hot end toward the rear end of the fireplace and the cold end forward, and said fluid path includes at least one pipe passing rearwardly from said jacket into the firepit area of said fireplace and curving up and forwardly to direct heated air into the air space forward of the fireplace.

5. Structure according to claim 4 wherein said frame includes a plurality of legs to raise said distributor from the fireplace bottom and suspend said hot end in the firepit.

6. Structure according to claim 5 wherein said fluid path includes a plurality of pipes emanating rearwardly from a forward manifold and arching through said firepit and terminating in a forwardly directed orientation to deliver heated air into the airspace forward of said fireplace, with said fluid mover being disposed in said manifold.

7. Structure according to claim 6 wherein said manifold is horizontally extended and provided in two sections with said Stirling engine generally centrally therebetween, and said fluid mover comprises a pair of blowers mounted in the respective sections of said manifold.

8. Structure according to claim 7 wherein said blowers are mounted on a common axle mounting a small pulley which is belt-driven by a larger pulley mounted on the drive shaft of said Stirling engine.

9. Structure according to claim 8 wherein said jacket has two fluid pipes emanating rearwardly therefrom and other pipes emanating directly from the rear of said manifold independently of said jacket.

10. Structure according to claim 9 wherein said manifold defines a plurality of discharge ports exiting into said pipes, and including a baffle curving forwardly from above said ports to a line substantially even with the axes of said blowers, and including a screen defining the top surface of said manifold to permit the ingress of air to be passed beneath said baffle by said blowers.

11. Structure according to claim 1 wherein said Stirling engine has a power cylinder and a displacement cylinder having cylindrical axes lying substantially in the same plane and linked by a crank operative in a cylindrical crankcase intersecting said plane, and said crankcase itself defines a gas passageway for reciprocating gas between said cylinders to obviate external passageways.

12. Structure according to claim 11 wherein said crank is a disk substantially occupying said crankcase to minimize the open volume thereof and leaving only a disk void as unoccupied space.

13. Structure according to claim 12 wherein said cylinders house a power piston and a displacement piston respectively, which pistons are linked to said crank disk by means of connecting rods which are flat and have thickness substantially equal to the thickness of said disk void to partially occupy the volume thereof.

14. Structure according to claim 13 wherein said rods are of planform shape substantially following the locus of points defining their maximum possible planform width while still clearing the surrounding structure in said engine throughout its full operative cycle.

15. Structure according to claim 14 wherein said cylindrical crankcase has an axis perpendicular to the axes of said power and displacement cylinders and said disk void is defined on one side by a cylindrical plug and on the other side by said crank disk, and the proximal surfaces of said pistons near said crankcase are contoured to conform to said cylindrical plug and crank disk, and are spaced by said connecting rods such that at their topmost position in the cycle of said engine, said pistons lie substantially flush against the surfaces of said plug and crank.

* * * * *